US006759989B2

(12) United States Patent
Tarvas et al.

(10) Patent No.: US 6,759,989 B2
(45) Date of Patent: Jul. 6, 2004

(54) INTERNAL MULTIBAND ANTENNA

(75) Inventors: Suvi Tarvas, Oulu (FI); Mari Panuma, Oulu (FI); Anne Isohätälä, Kello (FI)

(73) Assignee: Filtronic LK Oy, Kempele (FI)

( * ) Notice: Subject to any disclaimer, the term of this patent is extended or adjusted under 35 U.S.C. 154(b) by 0 days.

(21) Appl. No.: 10/273,546

(22) Filed: Oct. 18, 2002

(65) Prior Publication Data

US 2003/0076268 A1 Apr. 24, 2003

(30) Foreign Application Priority Data

Oct. 22, 2001 (FI) ..... 20012045

(51) Int. Cl.[7] ..... H01Q 1/38
(52) U.S. Cl. ..... 343/700 MS; 343/702; 343/725
(58) Field of Search ..... 343/700 MS, 702, 343/725, 767, 770, 846, 848

(56) References Cited

U.S. PATENT DOCUMENTS

| | | | | |
|---|---|---|---|---|
| 6,121,930 A | | 9/2000 | Grangeat et al. | 343/700 |
| 6,133,880 A | * | 10/2000 | Grangeat et al. | 343/700 MS |
| 6,218,990 B1 | * | 4/2001 | Grangeat et al. | 343/700 MS |
| 6,225,951 B1 | * | 5/2001 | Holshouser et al. | 343/700 MS |
| 6,252,554 B1 | * | 6/2001 | Isohatala et al. | 343/700 MS |
| 6,380,903 B1 | * | 4/2002 | Hayes et al. | 343/725 |
| 6,380,905 B1 | * | 4/2002 | Annamaa et al. | 343/767 |
| 6,529,168 B2 | * | 3/2003 | Mikkola et al. | 343/702 |
| 6,552,686 B2 | * | 4/2003 | Ollikainen et al. | 343/700 MS |

FOREIGN PATENT DOCUMENTS

| | | | |
|---|---|---|---|
| CH | 511295 | 9/1999 | H01Q/1/24 |
| FI | 105421 | 8/2000 | H01Q/1/38 |
| FI | 0790662 | 3/2001 | H01Q/1/24 |

OTHER PUBLICATIONS

Survi Tarvas, et al., "Planar Dual–Frequency Antenna and Radio Apparatus Employing a Planar Antenna" U.S. patent application O. 09/477,907, filed Jan. 5, 2000.

* cited by examiner

*Primary Examiner*—Tan Ho
(74) *Attorney, Agent, or Firm*—Darby & Darby

(57) ABSTRACT

A multiband antenna applicable as an internal antenna in small mobile terminals especially. The antenna (200) is a PIFA placed inside the housing of a mobile station with at least two operating bands. A first resonance falling into a lower operating band is produced by means of a radiating conductive pattern (B21) in planar element (220). To improve the characteristics of the antenna in the upper operating band the planar element further comprises a slot (232) which goes between the feed point (F) and the short-circuit point (S) of the antenna. The radiator provided by this slot can be considered a quarter-wave slot radiator or a half-wave loop radiator. The PIFA further may have another radiator, which resonates in the upper operation band. By means of said slot the upper operating band of an antenna can be widened or the radiation in the horizontal plane in the upper operating band can be made more effective.

9 Claims, 4 Drawing Sheets

INTERNAL MULTIBAND ANTENNA

BACKGROUND

The invention relates to a multiband antenna applicable as an internal antenna in small mobile terminals especially.

In the field of mobile stations, models have become popular which operate in two or more systems, each with a different frequency band. A basic prerequisite for the operation of a communications device is that the radiation and receiving characteristics of its antenna are satisfactory in all bands of the systems in question. Important characteristics are e.g. antenna's bandwidth and radiation pattern. It is relatively easy to produce a multiband antenna structure with good quality if no limitations are imposed on its size. However, in mobile terminals the antenna should understandably be very compact. Moreover, the current trend is to place the antenna preferably inside the housing of the device for convenience. This makes antenna design more demanding.

An antenna with good enough characteristics which fits inside a small device is in practice most easily implemented as a planar structure: The antenna comprises a radiating plane and a ground plane parallel thereto. To make matching easier, the radiating plane and ground plane are usually interconnected at a suitable point by a short-circuit conductor, producing a so-called planar inverted F antenna, or PIFA. The number of operating bands can be raised to two by dividing the radiating plane by means of a non-conductive slot into two branches, viewed from the feed point, which branches have different lengths so that the resonance frequencies of the antenna portions corresponding to the branches fall into desired points at frequency axis.

Another way to provide a second operating band in a planar antenna is to use a slot radiator. A PIFA structure shown in FIG. 1, disclosed in patent application FI990006, represents such a known antenna. It comprises a ground plane GND and a radiating planar element 120. Connected to the radiating plane is an antenna feed conductor at a point F, and a short-circuit conductor at a point S close to the feed point. The radiating planar element 120 has a slot 130 extending from the edge of the element to the center region thereof. Especially the antenna feed point F is relatively close to the end of the slot 130, which opens into the edge of the plane. The planar element proper resonates in the lower one of the intended operating bands. The dimensions of the slot are such that it resonates in the second, upper, operating band. FIG. 1 also shows a support structure 105 for the radiating plane, being a frame made of dielectric material and having relatively thin walls.

In the dual-band structures described above the upper operating band in particular may prove problematic because of its limited width; its coverage of even a band reserved for a single system may be poor. The problem is emphasized if the aim is to cover the bands of at least two systems, e.g. ones operating in the frequency range 1.7 to 2.0 GHz. Another disadvantage is that the radiation in the horizontal plane especially and in the upper operating band may be less effective than desired. One solution is to increase the number of antenna elements. For example, on top of a radiating plane there may be another radiating plane fed galvanically or electromagnetically. The resonance frequency of the second radiating plane is arranged to be near the upper resonance frequency of the lower plane so that a continuous, relatively wide operating band is provided. Electromagnetically coupled, i.e. parasitic, elements may also be placed on the same geometric plane with the radiating main plane. A disadvantage in the use of parasitic elements is that it adds to the production costs of the antenna and makes it more difficult to achieve repeatability in production. A handicap in the circuit board design of a radio device may be alone a connecting pad required for the short-circuit conductor of a parasitic element on the circuit board below.

SUMMARY

An object of the invention is to realize in a new, more advantageous manner an internal antenna for a mobile terminal with at least two operating bands. That which is specified in the independent claim 1 characterizes an antenna structure according to the invention. Some advantageous embodiments of the invention are presented in the dependent claims.

The basic idea of the invention is as follows: The antenna is a PIFA placed inside the housing of a mobile terminal with at least two operating bands. A first resonance falling into a lower operating band is produced by means of a radiating conductive pattern in planar element. To improve characteristics of the antenna in the upper operating band the planar element further comprises a slot according to the invention which goes between the feed point and the short-circuit point of the antenna. The radiator provided by this slot can be considered a quarter-wave slot radiator or a half-wave loop radiator. The PIFA further may have another radiator, which resonates in the upper operation band. An extendable whip element may be added to the structure.

An advantage of the invention is that the upper operating band of an antenna can be widened with the slot or loop radiator according to the invention so that the second band easily covers the bands used by even two mobile communications systems. Another advantage of the invention is that the radiation in the horizontal plane in the upper operating band of the antenna can be made more effective with the loop radiator according to the invention. A further advantage of the invention is that the slot according to the invention can be implemented without substantially degrading the matching in the first operating band of the antenna. A further advantage of the invention is that the structure according to it is simple and inexpensive to fabricate.

DESCRIPTION OF THE DRAWINGS

The invention is below described in detail. The description refers to the accompanying drawings in which.

DETAILED DESCRIPTION OF ILLUSTRATIVE EMBODIMENTS OF THE INVENTION

Figure 1:
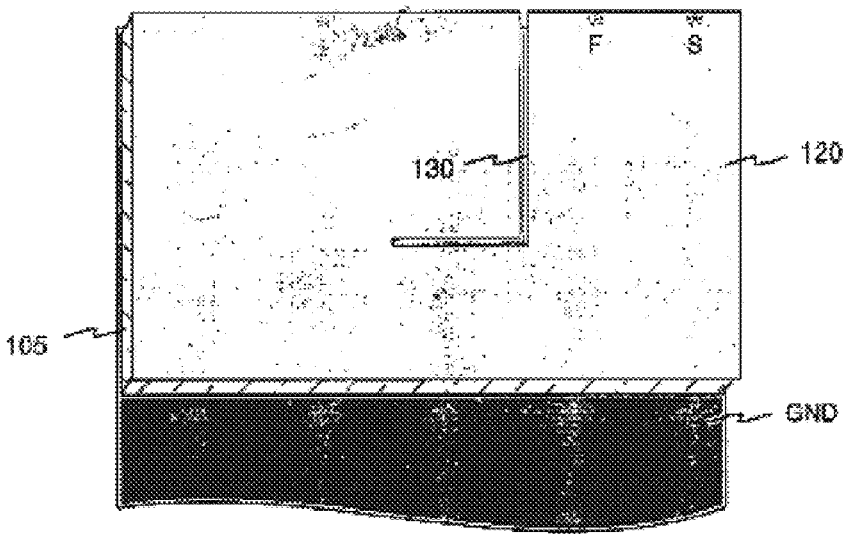
Fig. 1 PRIOR ART
FIG. 1 shows an example of an antenna structure according to the prior art.

FIG. 1 was already discussed in conjunction with the description of the prior art.

Figure 2A:
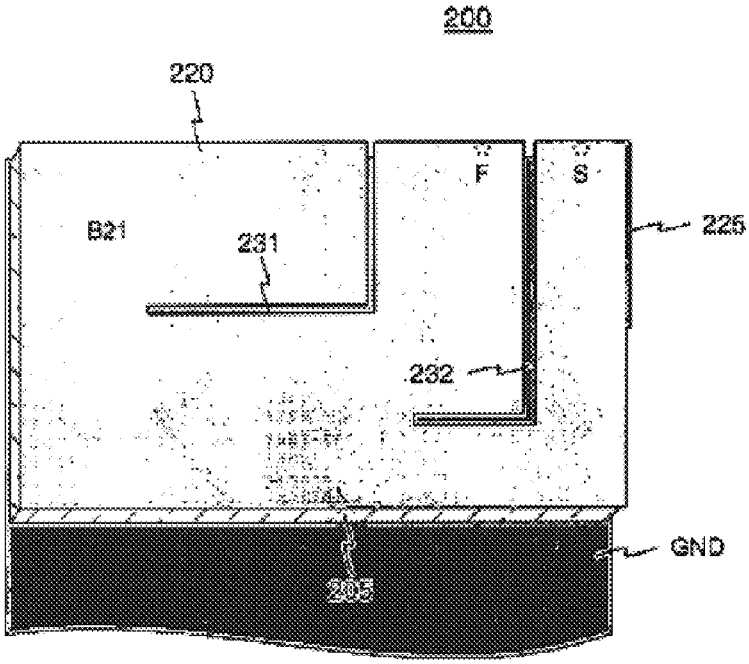
FIG. 2*a* shows an example of an antenna structure according to the invention.
Figure 2B:
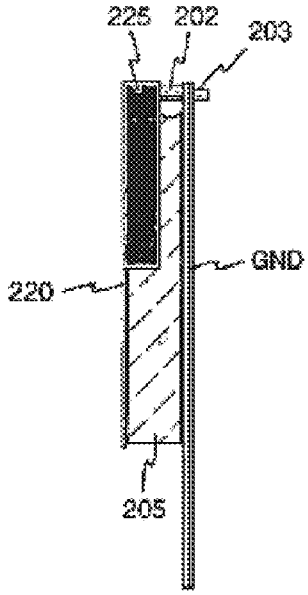
FIG. 2*b* shows the structure of FIG. 2 in a lateral view.

FIGS. 2*a* and 2*b* illustrate an example of an antenna structure according to the invention. The structure 200 comprises a ground plane GND, a rectangular radiating planar element 220, a feed point F and short-circuit point S thereof, a first slot 231 and a support frame 205 like in the structure of FIG. 1. The feed point and short-circuit point are located in this example in the vicinity of one of the longer sides of the radiating plane, close to a corner of the plane. The first slot 231 starts from the same edge, from the other side of the feed point as viewed from the short-circuit point. A substantial difference to FIG. 1 is that the radiating plane now further comprises a second slot 232 according to the invention. It begins from the edge of the radiating plane, at a point between the feed and short-circuit points, and ends up at the inner region of the plane.

The antenna structure 200 has got two operating bands and three such resonances that are significant from the operating point of view. The radiating plane 220 includes a conductive branch B21 which starts from the short-circuit point S and warps around the end of the first slot and which together with the ground plane constitutes a quarter-wave resonator and functions as a radiator in the lower operating band of the antenna. The location and dimensions of the first slot 231 are such that it together with the surrounding conductive plane and ground plane constitutes a quarter-wave resonator and functions as a radiator in the upper operating band of the antenna. The dimensions of the second slot 232 are also such that it together with the surrounding conductive plane and ground plane constitutes a quarter-wave resonator and functions as a radiator in the upper operating band of the antenna. Thus the resonance frequencies of the two slot radiators are arranged to be relatively near one another but yet unequal so that the upper operating band becomes relatively wide. In this example, the resonance frequency of the second slot radiator is made suitable not only by means of the slot dimensions but also with a conductive plate 225 which extends towards the ground plane from the shorter side nearest to the short-circuit point S of the planar element 220.

The second slot 232 naturally affects the antenna matching in the lower operating band. This can also be exploited by optimizing said matching by shaping the second slot in an appropriate manner.

FIG. 2*b* shows the antenna structure of FIG. 2*a* viewed from the side where the conductive plate 225 is located. In this example the conductive plate 225 is about half the length of the side of the planar element and reaches a little over half way between the planar element and ground plane in the direction of the normal of the planar element 220. Similar extensions to the radiating plane are common in planar antennas. Usually the extension is placed at the open end of a radiating branch, increasing the capacitance there as well as the electrical length of the branch. In this case the extension to the plane is near the short-circuit point, increasing the electrical length of the second radiating slot. At the same time the extension, i.e. conductive plate 225, strengthens the resonance of the second slot. FIG. 2*b* further shows a conductor 202 connecting the short-circuit point S to the ground plane GND. Antenna feed conductor 203 can be seen behind the short-circuit conductor.

Figure 3:
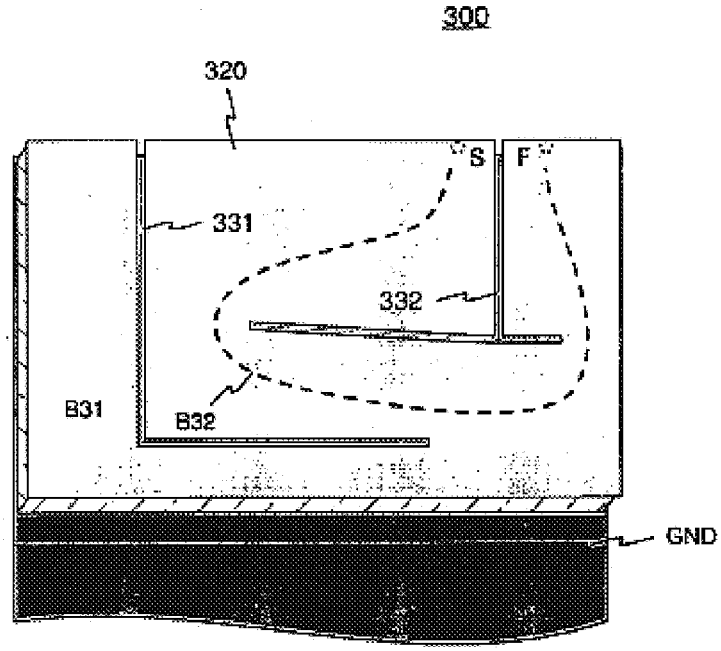
FIG. 3 shows a second example of an antenna structure according to the invention.

FIG. 3 shows a second example of an antenna structure according to the invention. The structure is similar to the structure in FIG. 2; the differences are such that the shapes of the first and the second slot in the radiating element 320 deviate from those in FIG. 2, and the places of the feed point and short-circuit point are exchanged with each other. The first slot 331 is shaped so that the antenna has two operating bands also without the second slot. Substantial is the shape of the second slot 332. This branches into two directions thus having two closed ends. The second slot is dimensioned so that it produces a conductive loop B32 between the feed point F and short-circuit point S, the electrical length of which is half the wave-length in the upper operating band. For this reason the loop B32 radiates in the upper operating band. The second slot is shaped so that current distribution in the loop B32 is quite large. This changes polarization of the radiation resulting in that radiation particularly in the horizontal plane, when the radiating plane is in vertical position, strengthens. In accordance with simulation results the average antenna gain rises about 6 dB in the upper operating band. The minimum gain rises yet more, which means that the radiation pattern becomes more even.

Figure 4:
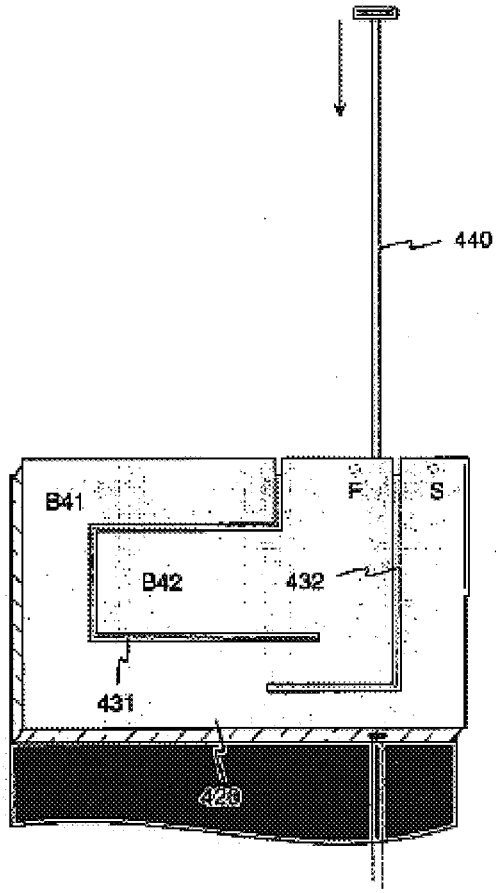
FIG. 4 shows a third example of an antenna structure according to the invention.

FIG. 4 shows a third example of an antenna structure according to the invention. In this case a planar element 420 includes a first slot 431 and a second slot 432. Mainly the first slot is shaped such that the planar element has got two radiating branches. The first one B41 of these is longer and resonates in the lower operating band of the antenna. The resonance frequency corresponding to the second branch B42 falls into the upper operating band of the antenna, as does the resonance frequency corresponding to the second slot 432 according to the invention. The two latter resonance frequencies are in this case, too, suitably near one another so that the upper operating band is relatively wide.

The antenna structure of FIG. 4 also includes a whip element 440 movable along its axis. The whip element is extended, being galvanically coupled to the radiating planar element 420 near the feed point F and enhancing the performance of the antenna e.g. in the lowest operating band. The retracted whip has no significant coupling with the rest of the antenna structure. Alternatively, a separate feed may be arranged for the whip element, in which case it will not have a galvanic coupling with the planar element even in the extended position.

Figure 5:
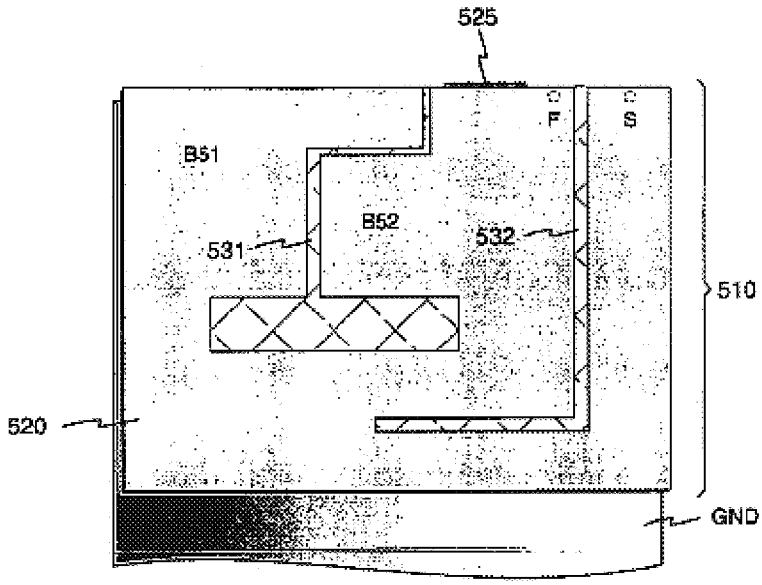
FIG. 5 shows a fourth example of an antenna structure according to the invention.

FIG. 5 shows a fourth example of an antenna structure according to the invention. It, too, has a first slot 531, which divides the planar element 520 into two branches B51 and B52 that resonate in different operating bands. The structure also includes a second slot 532 going between the feed and short-circuit points and resonating in the same operating band as the second branch B52. It differs from the structure of FIG. 2*a* in that the first slot 531 in this example has two portions; a relatively narrow first portion starting from the edge of the plane 520 and ending at the longitudinal side of the second, relatively wide portion. This shape, which is known as such, further increases the bandwidth. In the example of FIG. 5 the radiating plane 520 is not a rigid conductive plate but a conductive layer on the upper surface of a circuit board 510. As a tuning element there is an extension plate 525 to the radiating plane, located on the long side of the radiating plane between the feed point F and the beginning of the first slot 531.

For brevity, in this description and in the claims it is talked about resonating conductive branches and slots. In so doing, however, it is referred to the whole resonating structure, including, in addition to the branch or slot in question, also the ground plane and the space between the ground plane and radiating plane.

Figure 6:
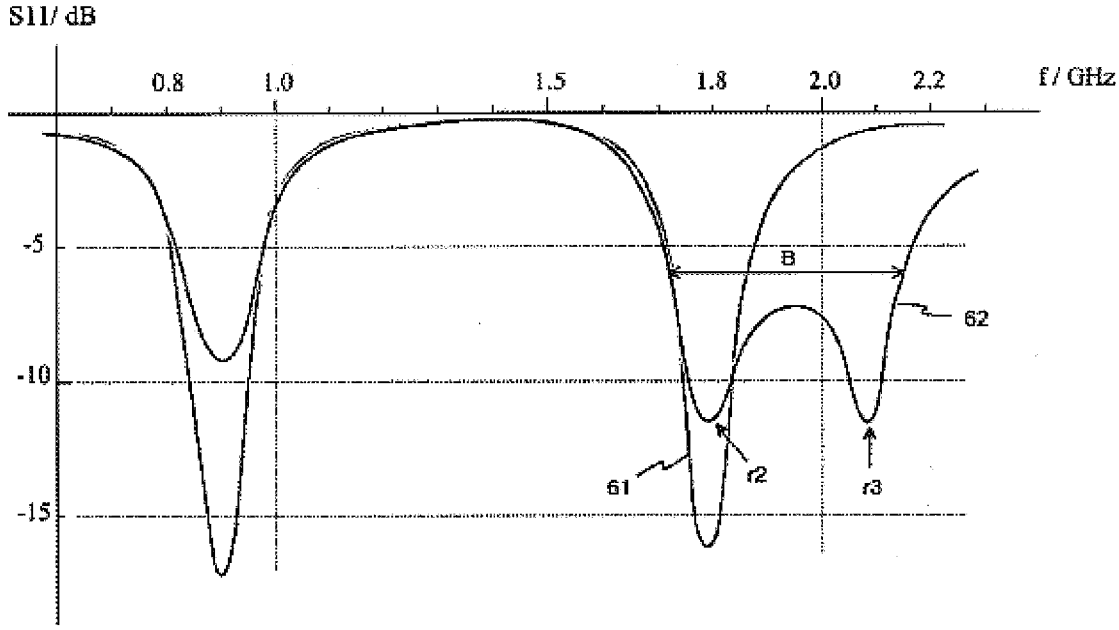
FIG. 6 shows an example of band characteristics of an antenna according to the invention.

FIG. 6 shows an example of frequency characteristics of an antenna according to the invention. Shown in FIG. 6 are curves of reflection coefficient S11 as a function of frequency. Curve 61 shows the alteration of the reflection coefficient of a prior-art antenna according to FIG. 1, and curve 62 similarly shows the alteration of the reflection coefficient of an antenna structure according to FIGS. 2*a,b*. The curves show that for the antenna according to the invention the width B of the upper operating band is about 440 MHz, while for the reference antenna it is only about 140 MHz. The criterion for the band cut-off frequency is here the reflection coefficient value 6 dB. The upper operating band thus becomes much wider. This is based on the resonance r3 of the second radiating slot the frequency of which is arranged to be at a suitable distance above the frequency of the resonance r2 of the first radiating slot. In the lower operating band of the antenna the change according to the invention will in this case reduce the attenuation peak and make the band a little narrower. However, the lower operating band can easily be made to cover the band required by the GSM 900 system, for example.

Figure 7:
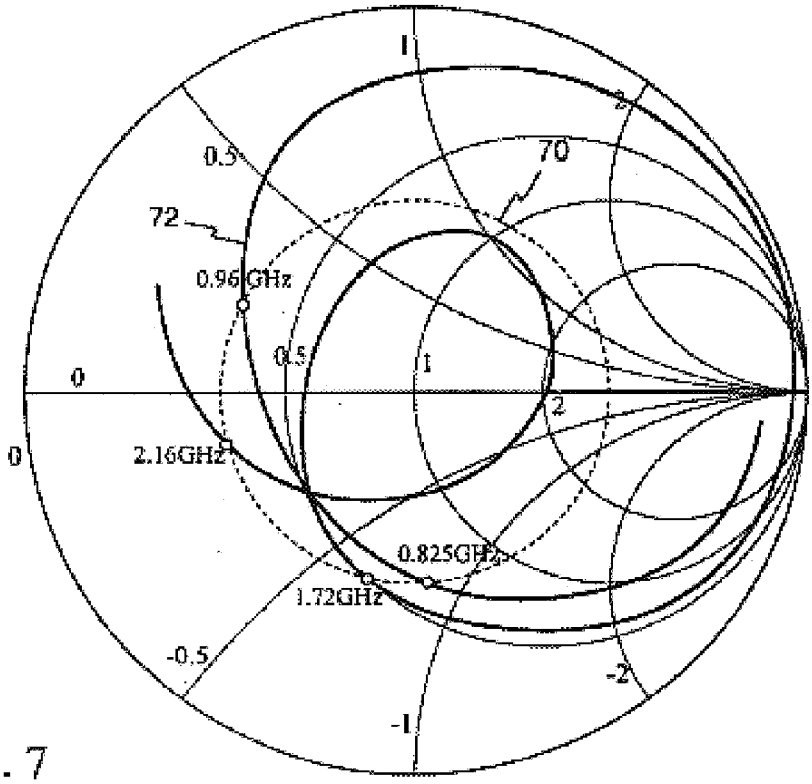
FIG. 7 shows an example of the reflection coefficient of an antenna according to the invention.

FIG. 7 illustrates, using a Smith's chart, the quality of matching in the antenna for which the reflection coefficient curve 62 was drawn. Curve 72 shows the alteration of the complex reflection coefficient as a function of frequency. A circle 60 drawn in a dashed line marks the limit within which the absolute value of the reflection coefficient is smaller than 0.5, i.e. −6 dB. Curve 72 shows, among other things, that the loop corresponding to the range of the upper operating band is totally inside the circle 60, which has been the aim of the matching.

Figure 8:
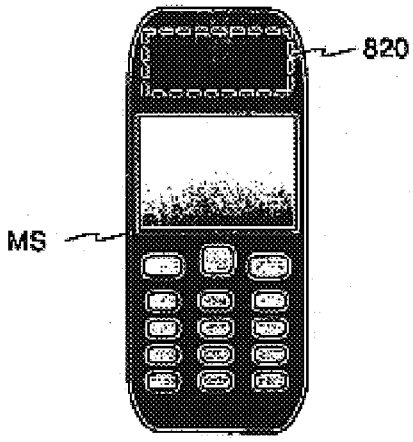
FIG. 8 shows an example of a mobile station equipped with an antenna according to the invention.

FIG. 8 shows a mobile station MS including an antenna structure according to the invention. A radiating planar element 820 belonging to the structure is located completely within the housing of the mobile station.

In the foregoing some antenna structures according to the invention are described. The invention does not limit the antenna element shapes to those described above. Neither does the invention limit the fabrication method of the antenna or the materials used therein. The inventional idea may be applied in different ways within the scope defined by the independent claim 1.

What is claimed is:

1. An internal antenna of a radio device, which antenna has at least a lower and an upper operating band and comprises a ground plane and a radiating planar element with an antenna feed point, a short-circuit point and a first slot starting from an edge of the planar element, conductive plane of the planar element being arranged to resonate in the lower operating band, wherein the planar element further comprises a second slot starting from said edge thereof, going between the feed point and the short-circuit point and being arranged to cause a resonance in the upper operating band.

2. An internal antenna according to claim 1, the second slot being arranged to resonate in the upper operating band of the antenna and the electrical length of the second slot being quarter-wavelength when it resonates.

3. An internal antenna according to claim 1, the second slot being arranged to produce, between the feed point and the short-circuit point, a conductive loop the electrical length of which is half the wavelength in the upper operating band.

4. An internal antenna according to claim 1, said first slot being arranged to resonate in the upper operating band of the antenna.

5. An internal antenna according to claim 1, wherein the first slot divides the planar element into two branches, one of which is arranged to resonate in the upper operating band of the antenna.

6. An internal antenna according to claim 2, shape of the second slot being arranged to improve antenna matching in the lower operating band.

7. An internal antenna according to claim 2, said planar element comprising on the second slot's side an extension directed towards the ground plane to tune resonance frequency of the second slot.

8. An internal antenna according to claim 1, further comprising a movable whip element which, when extended, is galvanically coupled to the planar element.

9. A mobile terminal with an internal antenna which has at least a lower and upper operating band and comprises a ground plane and a radiating planar element with an antenna feed point, a short-circuit point and a first slot starting from an edge of the planar element, conductive plane of the planar element being arranged to resonate in the lower operating band, wherein the planar element further comprises a second slot starting from said edge thereof, going between the feed point and short-circuit point and being arranged to cause a resonance in the upper operator band.

* * * * *